United States Patent [19]

Wiese

[11] 3,995,832

[45] Dec. 7, 1976

[54] COLLAPSIBLE BLEACHER RAIL

[76] Inventor: Harold Wiese, Madison, S. Dak. 57042

[22] Filed: Oct. 10, 1973

[21] Appl. No.: 404,994

[52] U.S. Cl. ..... 256/59; 52/183; 182/78; 182/106; 256/65

[51] Int. Cl.[2] ..... E04H 17/14

[58] Field of Search ..... 256/59, 65–70, 256/21, 24; 52/183, 9; 182/78, 106; 403/109

[56] References Cited

UNITED STATES PATENTS

| | | | |
|---|---|---|---|
| 2,225,889 | 12/1940 | Rubenstein | 403/109 X |
| 2,229,473 | 1/1941 | Redmer | 403/109 X |
| 2,757,002 | 7/1956 | Ryden | 403/109 X |
| 2,834,621 | 5/1958 | Schroer | 256/65 X |
| 2,873,904 | 2/1959 | McCormick | 182/106 |
| 2,918,150 | 12/1959 | Blum | 256/65 UX |
| 2,933,149 | 4/1960 | Lee | 182/78 |
| 3,083,784 | 4/1963 | Urian | 182/106 X |
| 3,263,773 | 8/1966 | Sallein | 182/106 X |
| 3,401,918 | 9/1968 | Wiese | 256/59 |
| 3,463,457 | 8/1969 | Alexander | 256/59 |
| 3,757,894 | 9/1973 | Chamberlin | 182/106 |

*Primary Examiner*—Dennis L. Taylor

[57] ABSTRACT

A collapsible bleacher railing in conjunction and for use with a collapsible bleacher section or sections, which includes normally vertical, upright, support sections having a plurality of telescoping handrail sections therebetween such that as the bleachers are moved to their relative locations, the handrail will extend and collapse therewith and therefore eliminate the requirement for removal from the bleacher sections.

10 Claims, 8 Drawing Figures

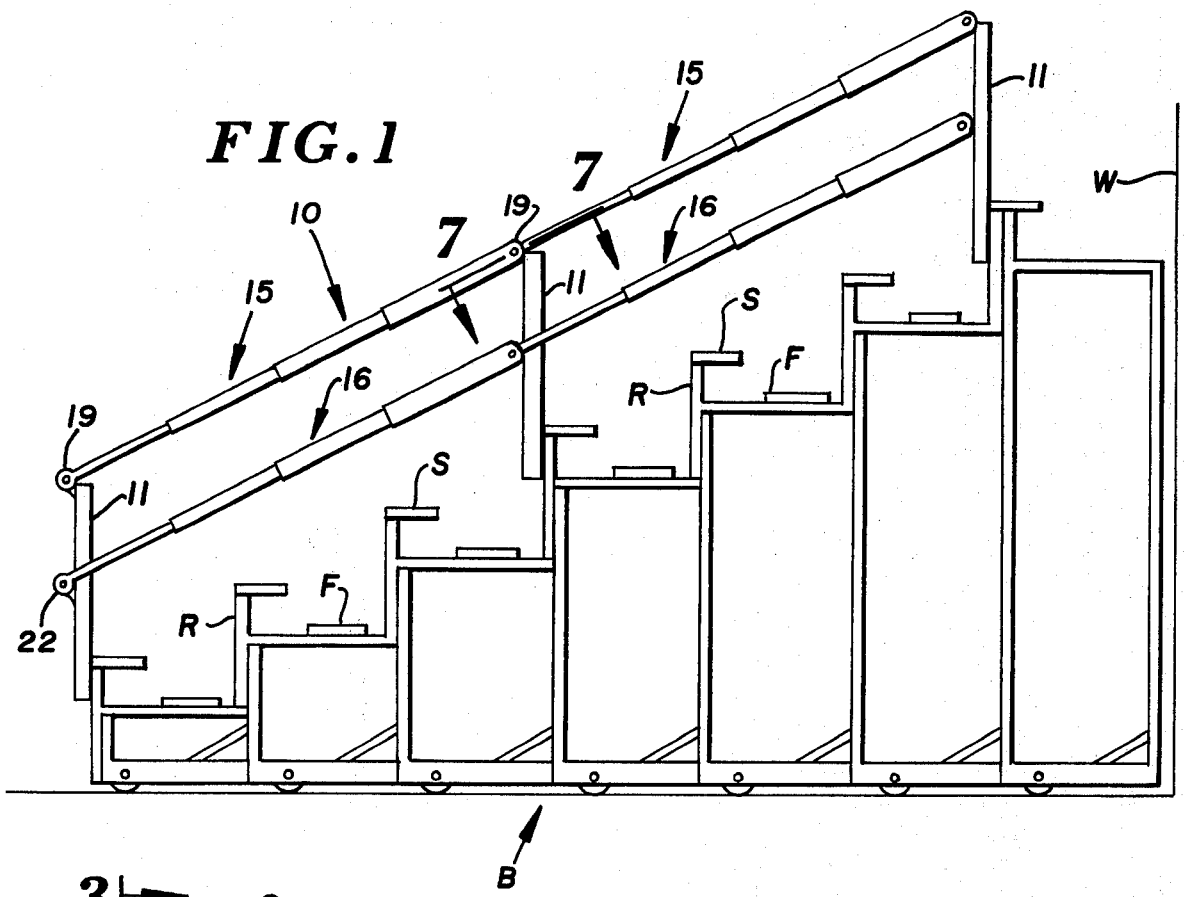
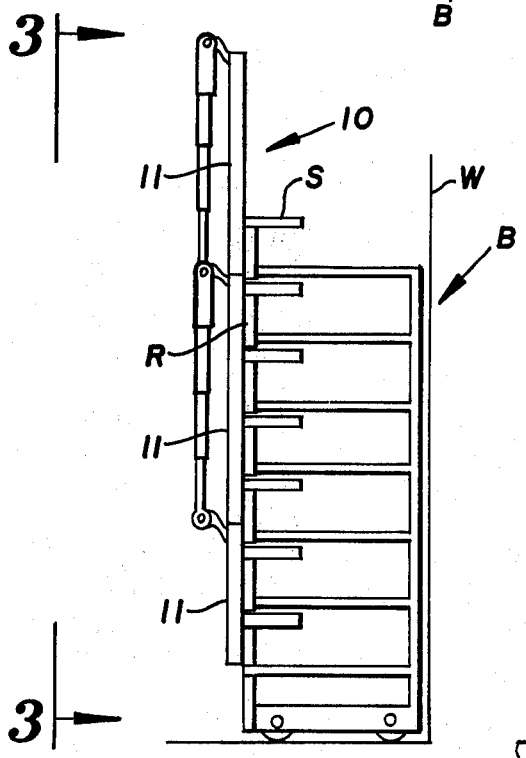
FIG. 2
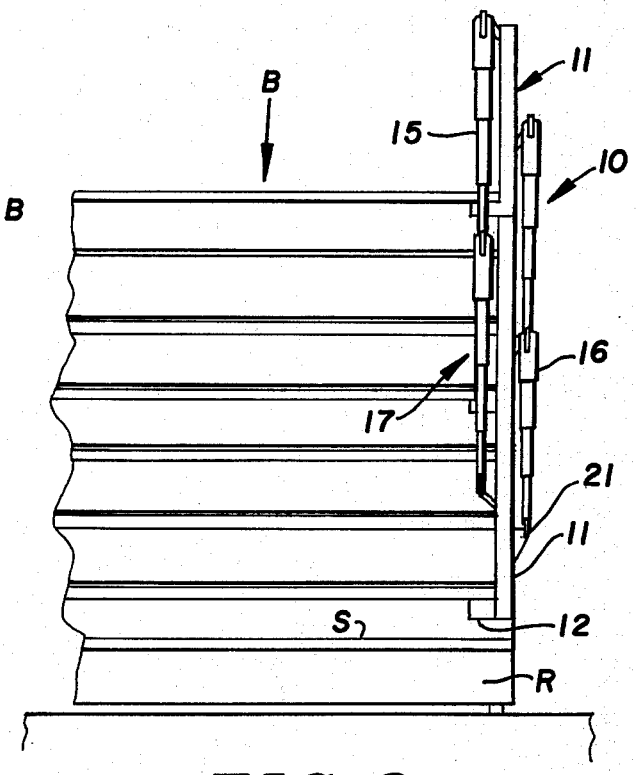
FIG. 3

COLLAPSIBLE BLEACHER RAIL

The use of foldable seating sections for auditoriums, gymnasiums and the like is well known. These sections are designed for relatively compact storage against a wall when not in use and obviously a more compact situation will give the greatest amount of useable room for other activities.

The basic problem that the applicant has solved for such bleachers is the handrail problem. Normally the hand rails had to be removed when the bleachers were in the storage position and replaced when the bleachers were moved to their open position. Applicant originally solved this problem with a structure disclosed and claimed in U.S. Pat. No. 3,401,918, issued Sept. 17, 1968. Although this structure was proven and did offer a solution to the problem, the structure was relatively complicated and the device as disclosed in this application provides a relatively simple solution to this handrail problem. Further, with the device disclosed herein, a plurality of hand or guardrails may be arranged and provided adjacent the bleachers. Many safety laws require at least one intermediate guardrail in addition to a hand rail and this is easily provided with applicant's concept.

It is therefore an object of applicant's invention to provide a collapsible handrail for use with collapsible or folding bleachers such that the bleachers may be folded and extended without removing the handrails therefrom.

It is a further object of applicants' invention to provide a telescoping handrail construction for use with foldable bleachers such that the rails will, when the bleachers are in their folded condition, be arranged adjacent thereto.

It is a further object of applicant's invention to provide a telescoping handrail construction which provides a guiding and supporting arrangement between the various telescoping sections which will provide a transversely rigid connection between the individual sections.

These and other objects and advantages of my invention will more fully appear from the following description made in connection with the accompanying drawings, wherein like reference characters refer to the same or similar parts throughout the several views, and in which:

FIG. 1 is a side elevation of a foldable bleacher set, in their extended position, and illustrating the handrail embodying the concepts of applicant's invention being mounted thereon;

FIG. 2 is a side elevation of a foldable bleacher set, in its folded or storage position, and illustrating the handrail as it would be positioned in such folded condition;

FIG. 3 is a partial front elevation taken substantially along Line 3—3 of FIG. 2;

In accordance with the accompanying drawings, applicant has designated his entire hand and guardrail concepts as 10 and has illustrated the same upon a foldable bleacher section, designated B.

Normally, although various designs for such bleachers are available, the concept of the bleachers is substantially illustrated in FIGS. 1 and 2. In FIG. 1, the bleachers are obviously in their extended position and this position best illustrates the risers R, seats S and footrest sections F. In the folded condition of FIG. 2, the footrest sections are arranged in vertical relation as likewise are the seat sections while the riser sections provide a generally vertical wall which obviously is spaced a particular distance from the wall W of the room as determined by the length of the footrest section.

Figure 4:
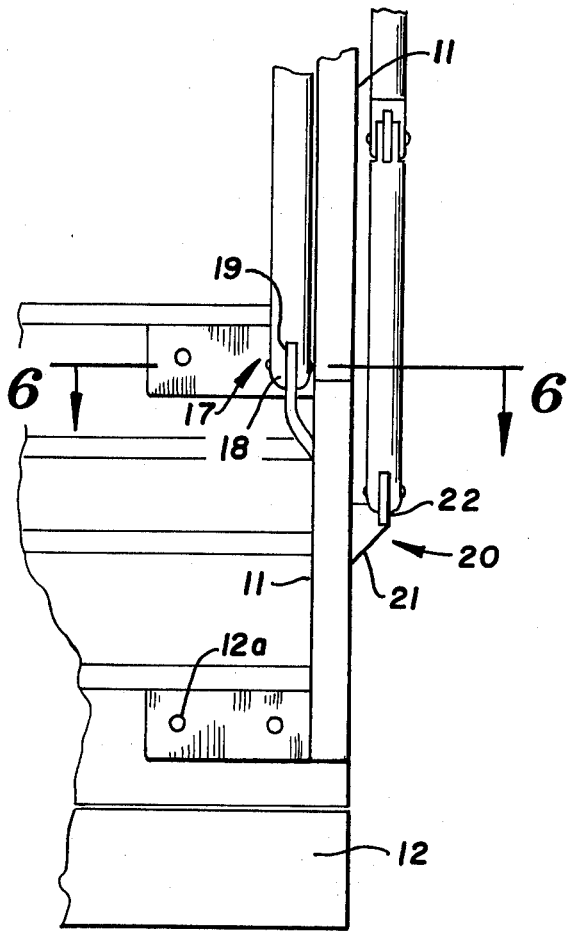
FIG. 4 is a partial front elevation, of an enlarged scale.
Figure 5:
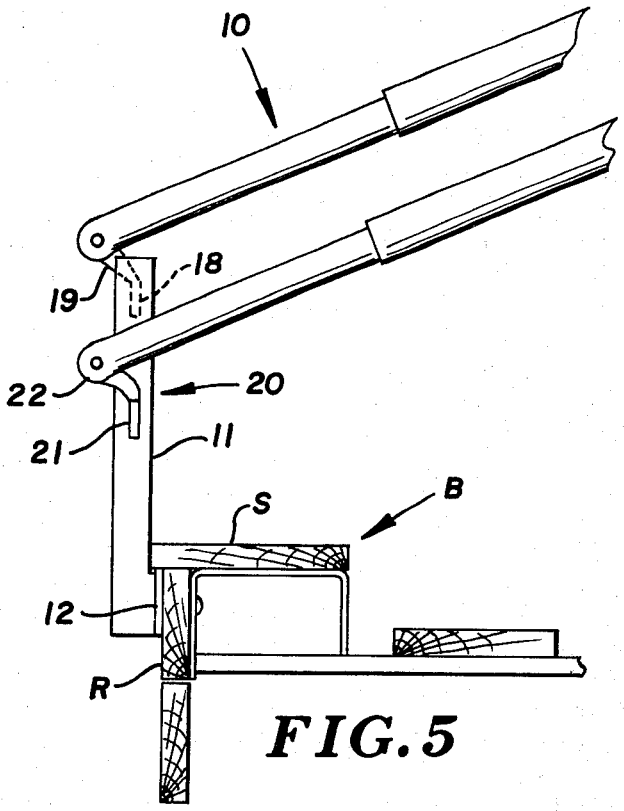
FIG. 5 is a partial side elevation of enlarged scale.

Applicant's hand and guardrail section 10 includes a plurality of vertical support members 11 spaced along the bleacher section and the means for mounting these vertical sections 11 is best illustrated in FIGS. 4 and 5. As illustrated in these views, the seat portion S of the bleacher is designed to extend slightly forward of the riser section R and a mounting plate 12 is provided on the lower end of the vertical support 11 and is of a predetermined length to permit attachment means such as capturing elements **12*a* to pass therethrough and through the riser R for securing the vertical support 11 to the riser. The width of the mounting plate 12** is sufficient to maintain the vertical support in alignment with the front of the seat S.

Figure 6:
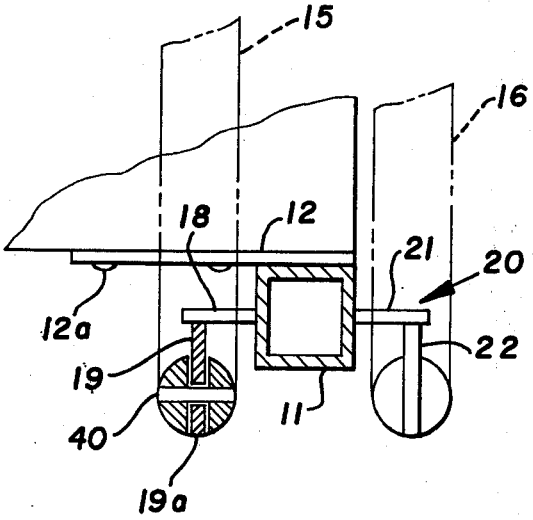
FIG. 6 is a horizontal section taken substantially along Line 6—6 of FIG. 4.

As illustrated in FIG. 6, the vertical support 11 may be formed from tubular square material but the particular shape of the verticals 11 is purely a matter of choice.

In order to provide a mounting or connection for the handrails, which handrails are defined as the upper rails and designated 15, and for mounting or connecting of the guardrails, which guardrails are defined as those rails below the handrails and designated 16, offset locating ears are provided respectively for each end of either the hand or guardrails.

The ear structure for mounting either of these rails is best illustrated in FIGS. 4, 5 and 6. As illustrated therein, the mounting flange or ear for the handrail is designated 17 and includes a first laterally and upwardly directed support bracket 18 having a forwardly directed upper connective end 19, which end 19 may be generally arcuate in shape thereby eliminating any sharp corners thereon. As illustrated, the bracket 18 is arranged adjacent the upper end of the vertical section 11 which will thereby position the connective end 19 slightly above and to the side of the vertical support 11. In this location then it should be obvious that when the bleachers are in their folded condition that the vertical supports 11 will be in line vertically with one another and the top of one such support 11 will directly underlie the bottom of the next above support 11. As illustrated in FIG. 6, a pin passage **19*a*** is formed through each of the connective ends such that the rail sections may be positively but rotatively connected thereto.

In order to provide a means for mounting the guardrails 16 to the vertical supports, a second bracket 20 is provided on the vertical supports 11 and this bracket is mounted on the side of the support 11 oppositely to the placement of the bracket 17. This bracket 20 also provides a laterally and upwardly directed support member 21 having an upwardly and forwardly directed connective end 22 thereon. This connective end 22 again is generally arcuate in shape and a passage is provided therethrough for connection of the ends of the guardrails 16 thereto. It should be obvious that with this offset connective construction for the guardrails, that they will also be in vertical alignment when the bleachers are collapsed or folded.

Figure 8:
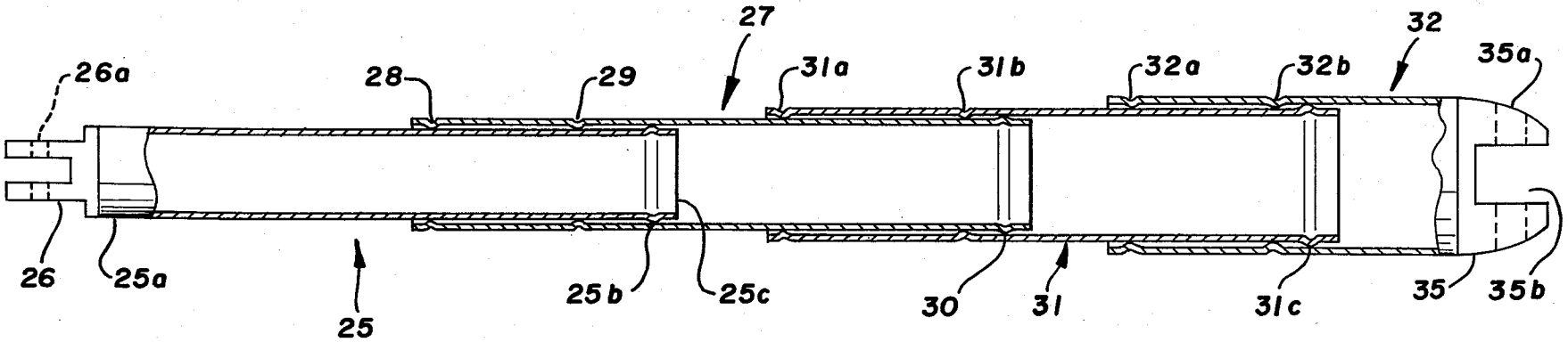
FIG. 8 is a longitudinal section taken substantially through one of the telescoping sections embodying the concepts of applicant's invention.

The typical construction of either the handrail or the guardrail is illustrated in FIG. 8 which is a longitudinal cross section of a telescoping unit embodying the concepts of applicant's invention but illustrating the same with only one specific set of end attachments thereon.

Figure 7:
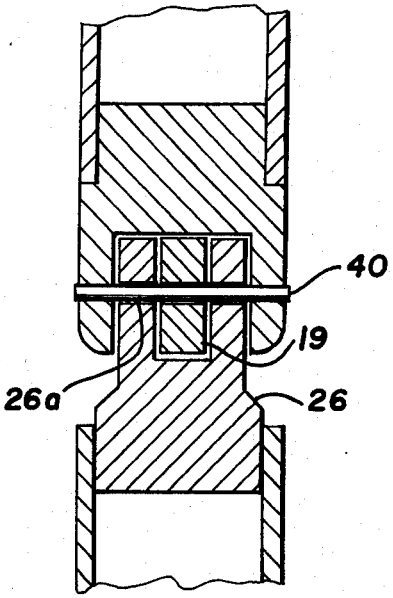
FIG. 7 is a section taken substantially along Line 7—7 of FIG. 1.

As illustrated in FIG. 8, a typical telescoping section includes a plurality of tubular sections, each of which is longitudinally receivable into the next adjacent section. The telescoping sections are specifically designed to provide a beam type loading situation between the individual members rather than relying upon a cantilever construction or mounting between the members. As illustrated, the first telescoping section includes a first attachment end 26 on the extending end thereof 25*a* which attachment end 26 provides a clevis having a passage 26*a* therethrough such that the same may be pinned to the attachment brackets with a pin member 40 as shown in FIGS. 6 and 7. It should be noted that the particular end 26 is of a flat sided configuration. Should this particular section be utilized at the lower end of a bleacher section, then this end would be substantially rounded to provide a safe grasping element for the user.

This first section, 25, provides a radially extending ring 25*b* on the opposite end 25*c* thereof which ring will serve as a stop for the next adjacent section.

The next adjacent telescoping section is designated 27 and, as are all the other sections, this section 27 is a tubular, tapered member. On what may be termed the forward end of section 27 a pair of longitudinally spaced, inwardly directed rings 28, 29 are formed. When the sections are fully extended, it should be obvious that ring 25*b* will abut with ring 29 and through proper sizing, ring 28 will be in contact with the periphery of section 25 to provide a two point support between the members. The opposite end of section 27 is provided with an extending ring 30 on the periphery thereof to again act as a stop in the same manner as ring 25*b*. Applicant has shown two additional sections 31, 32. Each of these sections are provided with the inwardly directed rings 31*a*, 31*b*, 32*a*, 32*b* and likewise, section 31 is provided with the outwardly directed stop ring 31*c*. It should be noted that the length between the various inwardly directed rings has been designated as L1 on sections 27 and 32 and as L2 on section 31. Applicant has found that by using alternative dimensions for the individual sections that the unit will freely move to its extended position. If these ring dimensions were identical then the sections would tend to nest when in their folded position and therefore would not permit shifting to the extended position in a comparatively free condition.

Obviously the number of telescoping sections involved in any one guard or handrail unit will depend upon the conditions of installation.

As illustrated in FIG. 8, section 32 has been provided with a connective end 35. This end 35 again provides a clevis arrangement with a passage therethrough and the sizing of the clevis is such as to receive the end 26 therein. A passage 35*a* is formed through this end and a pin 40, as illustrated in FIG. 7 will provide the positive but rotative connection between adjacent rail members and the attachment brackets of the vertical supports. It should be obvious that when the end 35 of a rail member is located at the uppermost section of a bleacher, that the sizing of the receiving area 35*b* of the clevis is modified to fit properly about the attachment bracket.

It should be obvious that although the unit illustrated consists of two such telescoping rail members for the guardrail and handrail, that this could be extended to any number.

The operation of the unit should be obvious from its structure as the telescoping units will both rotate and fold as the bleachers are folded and they likewise will rotate and extend when the bleachers are extended.

It should be obvious that applicant has provided a unique foldable hand rail construction for use with foldable bleacher sections that will provide a compact relation to the bleachers in their folded condition and will provide sufficient strength while in their extended position.

What I claim is:

1. In a seating structure combined with a hand rail, the improvement comprising:

a. at least a pair of spaced, generally vertical support members;

b. means for attaching the lower ends of said support members in ascending, spaced relation to said seating structure;

c. a rail member having sections in telescoping relationship providing joints between said sections at spaced positions along said rail member;

d. means for pivotally attaching one end of said rail member to one of said vertical support member; and e. pivot means at the other end of said rail member for pivotally attaching the other end of said rail member to the other of said support members.

2. A seating and hand rail structure as set forth in claim 2 including a second rail member which when said structure is in extended condition is longitudinally aligned with said first mentioned rail member, and including means for pivotally attaching one end of said second rail member to said other support member and to said other end of said first mentioned rail member.

3. A seating and hand rail structure as set forth in claim 1 in which said rail member includes at least three sections which provide joints between said sections at at least two positions along said rail member.

4. A seating and hand rail structure as set forth in claim 3 in which said rail member includes four sections providing joints between said sections at three positions along said rail.

5. A seating and hand rail structure as set forth in claim 1 including a second rail member which includes sections in telescoping relationship providing joints between said sections of said second rail member at spaced positions along said second rail member, means for pivotally attaching one end of said second rail member to said other support member and pivot means at the other end of said second rail member for pivotally attaching the other end of said second rail member to a third one of said vertical support members.

6. A seating and hand rail structure as set forth in claim 1 in which said sections include an inner section having an outer surface and an outer section which overlaps said inner section and has an inner surface, said outer section having a pair of spaced inwardly directed means, said means extending inwardly toward said outer surface of said inner section to provide a space between said surfaces.

7. A seating and hand rail structure as set forth in claim 6 in which said sections are tubular and said means includes rings extending radially inwardly toward said outer surface of said inner section.

8. A seating and hand rail structure as set forth in claim 6 in which said inner section has an outwardly directed means extending outwardly beyond the inner edge of said inwardly directed means of said outer section and providing a stop for preventing separation of said sections.

9. A seating and hand rail structure as set forth in claim 6 including a third section which has an inner surface and overlaps said outer section, said third section having spaced inwardly directed means, said means extending inwardly toward the outer surface of said outer section to provide a space between said inner surface of said third section and said outer surface of said outer section.

10. A seating and hand rail structure as set forth in claim 9 in which the spacing between said inwardly directed means on said third section is different from the spacing of said inwardly directed means on said outer section for avoiding nesting of said third section with said outer section.

* * * * *